US008769933B2

(12) United States Patent
Thompson et al.

(10) Patent No.: US 8,769,933 B2
(45) Date of Patent: Jul. 8, 2014

(54) METHOD TO OPERATE AN INTERNAL COMBUSTION ENGINE

(75) Inventors: Marleen F. Thompson, Mount Clemens, MI (US); Tomislav Ivo Golub, Austin, TX (US)

(73) Assignee: Detroit Diesel Corporation, Detroit, MI (US)

( * ) Notice: Subject to any disclaimer, the term of this patent is extended or adjusted under 35 U.S.C. 154(b) by 505 days.

(21) Appl. No.: 13/237,313

(22) Filed: Sep. 20, 2011

(65) Prior Publication Data

US 2013/0073177 A1 Mar. 21, 2013

(51) Int. Cl.
*F01N 3/00* (2006.01)

(52) U.S. Cl.
USPC ..... 60/285; 60/290; 60/295; 60/301; 701/66; 701/102; 701/110; 123/339.1

(58) Field of Classification Search
USPC ..... 60/272–324; 701/66, 102–110; 123/339.1
See application file for complete search history.

(56) References Cited

U.S. PATENT DOCUMENTS

| | | | | |
|---|---|---|---|---|
| 5,199,397 | A * | 4/1993 | Shelef et al. | 123/198 D |
| 6,363,906 | B1 * | 4/2002 | Thompson et al. | 123/198 DB |
| 6,535,142 | B2 * | 3/2003 | Wakabayashi et al. | 340/929 |
| 6,595,180 | B2 * | 7/2003 | Thompson et al. | 123/198 DB |
| 7,146,959 | B2 * | 12/2006 | Thompson et al. | 123/179.4 |
| 2008/0201064 | A1 * | 8/2008 | DiGonis | 701/110 |
| 2010/0058738 | A1 * | 3/2010 | Webb et al. | 60/285 |

* cited by examiner

*Primary Examiner* — Jesse Bogue
(74) *Attorney, Agent, or Firm* — Bill C. Panagos; Linda D. Kennedy; Butzel Long

(57) ABSTRACT

A method to operate a vehicle equipped an internal combustion engine and a transmission coupled to drive wheels. The vehicle is equipped with a parking brake and has an electronic control unit with memory and the engine in fluid communication with an exhaust aftertreatment system. The method includes the steps of determining whether the engine is operating in idle mode for a predetermined period of time; determining whether NOx emissions exceed a predetermined level after the predetermined period of time; and limiting the engine speed not to exceed a predetermined engine speed until an operator engages the parking brake and engages an engine ignition switch.

11 Claims, 3 Drawing Sheets

METHOD TO OPERATE AN INTERNAL COMBUSTION ENGINE

TECHNICAL FIELD

Government mandated emission standards have long been a consideration for vehicle and engine manufacturers. Emission levels have been legislated for hydrocarbon as well and NOx emissions, as well as other exhaust emission gasses. In an effort to gain more control over exhaust emissions, legislation has focused on the mode of the engine operation in a vehicle. One such mode of operation is the time spent in idle operation.

Idle operation of a vehicle, especially heavy duty diesel engine vehicles has been identified as one area where emission standards could be improved. CARB regulations have now mandated that idle operation of a vehicle be limited to a set time period so that emissions of NOx and hydrocarbons can be regulated during idle operation and the amount of time that an engine is operated in idle has been identified as a contributor to engine exhaust emission levels. However, it is sometimes necessary or desirable to continue to operate a vehicle in idle mode, even during idle operation that exceeds CARB mandated standards for emissions.

There is a need for a method to operate an engine in idle mode that exceeds governments mandated times for idle mode operation without violating CARB emission levels.

BRIEF SUMMARY OF THE INVENTION

In one non limiting embodiment, the present application relates to a method to operate a vehicle equipped an internal combustion engine and a transmission coupled to drive wheels. The vehicle is further equipped with a parking brake and has an electronic control unit with memory, and the engine is in fluid communication with an exhaust aftertreatment system. On such method includes the steps of determining whether the engine is operating in idle mode for a predetermined period of time; determining whether NOx emissions exceed a predetermined level after the engine has operated in idle mode for a predetermined period of time; and limiting the engine speed not to exceed a predetermined engine speed (such as, for example 900 rpm) until an operator engages the vehicle parking brake and engages an engine ignition switch, at which time the engine resumes normal engine operation.

In another embodiment, another method may optionally include determining whether said engine is operating in Power Take Off Mode (PTO) before determining whether said engine is operating in idle mode for a predetermined period of time, which time period is calibratible. The method may further optionally include operating the engine in normal mode when it is determined that the engine is operating in PTO mode. After the engine has completed operating in PTO mode, the method then determines whether the engine is operating in idle mode for a predetermined period of time after completing PTO mode of operation.

In another embodiment another method may include determining whether the engine is engaged in exhaust aftertreatment regeneration mode before determining whether said NOx emissions exceed a predetermined level, and then the engine may continue in normal operation mode if the engine is operating in exhaust aftertreatment regeneration mode After the regeneration mode is completed, the method may further include determining whether the NOx emission exceed a predetermined level, such as set forth in CARB, or greater than or equal to 30 g.

DETAILED DESCRIPTION OF THE PREFERRED EMBODIMENT(S)

Figure 1:
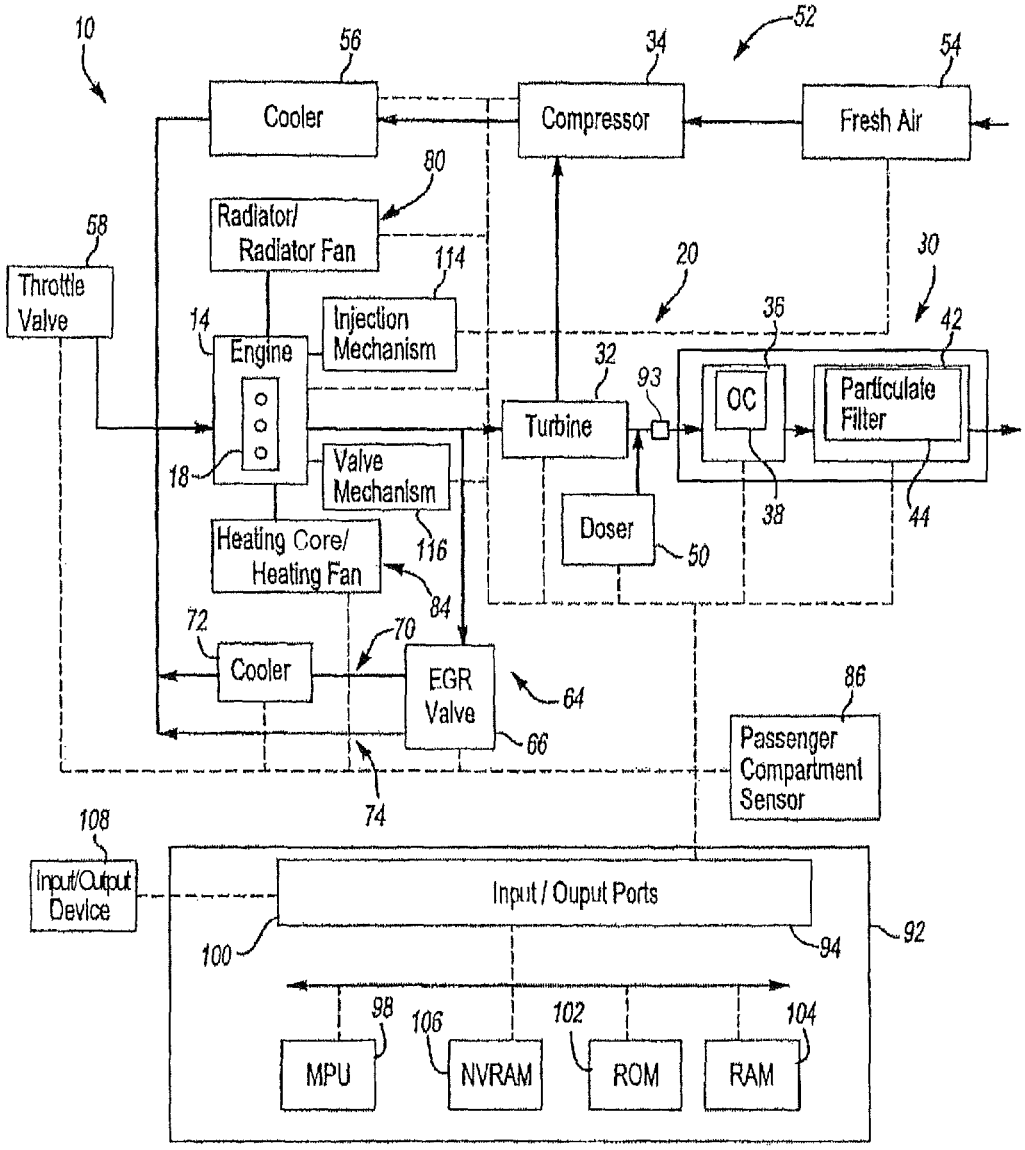
FIG. 1 is a schematic representation of and internal combustion engine with an electronic control.

FIG. 1 illustrates a vehicle 11 and vehicle powertrain system 10 in accordance with one non-limiting aspect of the present invention. The system 10 may provide power for driving any number of vehicles, including on-highway trucks, construction equipment, marine vessels, stationary generators, automobiles, trucks, tractor-trailers, boats, recreational vehicle, light and heavy-duty work vehicles, and the like.

The system 10 may be referred to as an internal combustion driven system wherein fuels, such as gasoline and diesel fuels, are burned in a combustion process to provide power, such as with a spark or compression ignition engine 14. The engine 14 may be a diesel engine that includes a number of cylinders 18 into which fuel and air are injected for ignition as one skilled in the art will appreciate. The engine 14 may be a multi-cylinder compression ignition internal combustion engine, such as a 4, 6, 8, 12, 16, or 24 cylinder diesel engines, for example. It should be noted, however, that the present invention is not limited to a particular type of engine or fuel. The system 10 may be coupled to a transmission 13, to transmit power to drive wheels 15 in any manner typical with the transmission of rotational power from the engine through a transmission to the drive wheels. The vehicle is equipped with brakes 17, and is further provided with a parking brake 19, to be activated by an operator as desired to secure the vehicle in a fixed position during idle operation of the engine.

Exhaust gases generated by the engine 14 during combustion may be emitted through an exhaust system 20. The exhaust system 20 may include any number of features, including an exhaust manifold and passageways to deliver the emitted exhaust gases to a particulate filter assembly 30, which in the case of diesel engines is commonly referred to as a diesel particulate filter. Optionally, the system 20 may include a turbocharger proximate the exhaust manifold for compressing fresh air delivery into the engine 14. The turbocharger, for example, may include a turbine 32 and a compressor 34, such as a variable geometry turbocharger (VGT) and/or a turbo compound power turbine. Of course, the present invention is not limited to exhaust systems having turbochargers or the like.

The particulate filter assembly 30 may be configured to capture particulates associated with the combustion process. In more detail, the particulate filter assembly 30 may include an oxidation catalyst (OC) canister 36, which in includes an OC 38, and a particulate filter canister 42, which includes a particulate filter 44. The canisters 36, 42 may be separate components joined together with a clamp or other feature such that the canisters 36, 42 may be separated for servicing and other operations. Of course, the present invention is not intended to be limited to this exemplary configuration for the particulate filter assembly 30. Rather, the present invention contemplates the particulate filter assembly including more or less of these components and features. In particular, the present invention contemplates the particulate filter assembly 30 including only the particulate filter 44 and not necessarily the OC canister 36 or substrate 38 and that the particulate filter 44 may be located in other portions of the exhaust system 20, such as upstream of the turbine 32.

The OC 38, which for diesel engines is commonly referred to as a diesel oxidation catalyst, may oxidize hydrocarbons and carbon monoxide included within the exhaust gases so as to increase temperatures at the particulate filter 44. The particulate filter 44 may capture particulates included within the exhaust gases, such as carbon, oil particles, ash, and the like, and regenerate the captured particulates if temperatures associated therewith are sufficiently high. In accordance with one non-limiting aspect of the present invention, one object of the particulate filter assembly 30 is to capture harmful carbonaceous particles included in the exhaust gases and to store these contaminates until temperatures at the particulate filter 44 favor oxidation of the captured particulates into a gas that can be discharged to the atmosphere.

The OC and particulate filter canisters 36, 42 may include inlets and outlets having defined cross-sectional areas with expansive portions there between to store the OC 38 and particulate filter 44, respectively. However, the present invention contemplates that the canisters 36, 42 and devices therein may include any number configurations and arrangements for oxidizing emissions and capturing particulates. As such, the present invention is not intended to be limited to any particular configuration for the particulate filter assembly 30.

To facilitate oxidizing the capture particulates, a doser 50 may be included to introduce fuel to the exhaust gases such that the fuel reacts with the OC 38 and combusts to increase temperatures at the particulate filter 44, such as to facilitate regeneration. For example, one non-limiting aspect of the present invention contemplates controlling the amount of fuel injected from the doser as a function of temperatures at the particulate filter 44 and other system parameters, such as air mass flow, EGR temperatures, and the like, so as to control regeneration. However, the present invention also contemplates that fuel may be included within the exhaust gases through other measures, such as by controlling the engine 14 to emit fuel with the exhaust gases.

An air intake system 52 may be included for delivering fresh air from a fresh air inlet 54 through an air passage to an intake manifold for introduction to the engine 14. In addition, the system 52 may include an air cooler or charge air cooler 56 to cool the fresh air after it is compressed by the compressor 34. Optionally, a throttle intake valve 58 may be provided to control the flow of fresh air to the engine 14. Optionally, the throttle intake valve 58 may also be provided to control the flow of EGR gases to the engine 14 or control both fresh air and EGR gases 64 to the engine 14. The throttle valve 58 may be a manually or electrically operated valve, such as one which is responsive to a pedal position of a throttle pedal operated by a driver of the vehicle. There are many variations possible for such an air intake system and the present invention is not intended to be limited to any particular arrangement. Rather, the present invention contemplates any number of features and devices for providing fresh air to the intake manifold and cylinders, including more or less of the foregoing features.

An exhaust gas recirculation (EGR) system 64 may be optionally provided to recycle exhaust gas to the engine 14 for mixture with the fresh air. The EGR system 64 may selectively introduce a metered portion of the exhaust gasses into the engine 14. The EGR system 64, for example, may dilute the incoming air charge and lower peak combustion temperatures to reduce the amount of oxides of nitrogen produced during combustion. The amount of exhaust gas to be recirculated may be controlled by controlling an EGR valve 66 and/or in combination with other features, such as the turbocharger. The EGR valve 66 may be a variable flow valve that is electronically controlled. There are many possible configurations for the controllable EGR valve 66 and embodiments of the present invention are not limited to any particular structure for the EGR valve 66.

The EGR system 64 in one non-limiting aspect of the present invention may include an EGR cooler passage 70, which includes an EGR cooler 72, and an EGR cooler bypass 74. The EGR valve 66 may be provided at the exhaust manifold to meter exhaust gas through one or both of the EGR cooler passage 70 and bypass 74. Of course, the present invention contemplates that the EGR system 64 may include more or less of these features and other features for recycling exhaust gas. Accordingly, the present invention is not intended to be limited to any one EGR system and contemplates the use of other such systems, including more or less of these features, such as an EGR system having only one of the EGR cooler passage or bypass.

A cooling system 80 may be included for cycling the engine 14 by cycling coolant there through. The coolant may be sufficient for fluidly conducting away heat generated by the engine 14, such as through a radiator. The radiator may include a number of fins through which the coolant flows to be cooled by air flow through an engine housing and/or generated by a radiator fan directed thereto as one skilled in the art will appreciated. It is contemplated, however, that the present invention may include more or less of these features in the cooling system 80 and the present invention is not intended to be limited to the exemplary cooling system described above.

The cooling system 80 may operate in conjunction with a heating system 84. The heating system 84 may include a heating core, a heating fan, and a heater valve. The heating core may receive heated coolant fluid from the engine 14 through the heater valve so that the heating fan, which may be electrically controllable by occupants in a passenger area or cab of a vehicle, may blow air warmed by the heating core to the passengers. For example, the heating fan may be controllable at various speeds to control an amount of warmed air blown past the heating core whereby the warmed air may then be distributed through a venting system to the occupants. Optionally, sensors and switches 86 may be included in the passenger area to control the heating demands of the occupants. The switches and sensors may include dial or digital switches for requesting heating and sensors for determining whether the requested heating demand was met. The present invention contemplates that more or less of these features may be included in the heating system and is not intended to be limited to the exemplary heating system described above.

A controller 92, such as an electronic control module or engine control module, may be included in the system 10 to control various operations of the engine 14 and other system or subsystems associated therewith, such as the sensors in the exhaust, EGR, and intake systems. Various sensors may be in electrical communication with the controller via input/output ports 94. The controller 92 may include a microprocessor unit (MPU) 98 in communication with various computer readable storage media via a data and control bus 100. The computer readable storage media may include any of a number of known devices which function as read only memory 102, random access memory 104, and non-volatile random access memory 106. A data, diagnostics, and programming input and output device 108 may also be selectively connected to the controller via a plug to exchange various information therebetween. The device 108 may be used to change values within the computer readable storage media, such as configuration settings, calibration variables, instructions for EGR, intake, and exhaust systems control and others.

The system 10 may include an injection mechanism 114 for controlling fuel and/or air injection for the cylinders 18. The injection mechanism 114 may be controlled by the controller 92 or other controller and comprise any number of features, including features for injecting fuel and/or air into a common-rail cylinder intake and a unit that injects fuel and/or air into each cylinder individually. For example, the injection mechanism 114 may separately and independently control the fuel and/or air injected into each cylinder such that each cylinder may be separately and independently controlled to receive varying amounts of fuel and/or air or no fuel and/or air at all. Of course, the present invention contemplates that the injection mechanism 114 may include more or less of these features and is not intended to be limited to the features described above.

The system 10 may include a valve mechanism 116 for controlling valve timing of the cylinders 18, such as to control air flow into and exhaust flow out of the cylinders 18. The valve mechanism 116 may be controlled by the controller 92 or other controller and comprise any number of features, including features for selectively and independently opening and closing cylinder intake and/or exhaust valves. For example, the valve mechanism 116 may independently control the exhaust valve timing of each cylinder such that the exhaust and/or intake valves may be independently opened and closed at controllable intervals, such as with a compression brake. Of course, the present invention contemplates that the valve mechanism may include more or less of these features and is not intended to be limited to the features described above.

In operation, the controller 92 receives signals from various engine/vehicle sensors and executes control logic embedded in hardware and/or software to control the system 10. The computer readable storage media may, for example, include instructions stored thereon that are executable by the controller 92 to perform methods of controlling all features and sub-systems in the system 10. The program instructions may be executed by the controller in the MPU 98 to control the various systems and subsystems of the engine and/or vehicle through the input/output ports 94. In general, the dashed lines shown in FIG. 1 illustrate the optional sensing and control communication between the controller and the various components in the powertrain system. Furthermore, it is appreciated that any number of sensors and features may be associated with each feature in the system for monitoring and controlling the operation thereof.

In one non-limiting aspect of the present invention, the controller 92 may be the DDEC controller available from Detroit Diesel Corporation, Detroit, Mich. Various other features of this controller are described in detail in a number of U.S. patents assigned to Detroit Diesel Corporation. Further, the controller may include any of a number of programming and processing techniques or strategies to control any feature in the system 10. Moreover, the present invention contemplates that the system may include more than one controller, such as separate controllers for controlling system or subsystems, including an exhaust system controller to control exhaust gas temperatures, mass flow rates, and other features associated therewith. In addition, these controllers may include other controllers besides the DDEC controller described above.

In accordance with one non-limiting aspect of the present invention, the controller 92 or other feature, may be configured for permanently storing emission related fault codes in memory that is not accessible to unauthorized service tools. Authorized service tools may be given access by a password and in the event access is given, a log is made of the event as well as whether any changes that are attempted to made to the stored fault codes. It is contemplated that any number of faults may be stored in permanent memory, and that preferably eight such faults are stored in memory.

Figure 2:
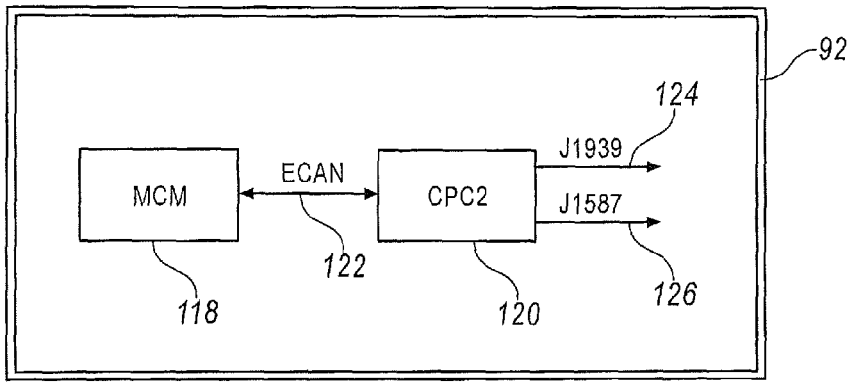
FIG. 2 is a schematic representation of the engine controller in the present invention

FIG. 2 is a schematic representation of the controller 92 of the present invention. The controller has a Motor Control Module 118 and a Common Powertrain Controller 120. Each of the Common Powertrain Controller and the Motor Control Module has memory for storage and retrieval of operating software and faults. The Motor Control Module and the Common Powertrain Controller communicate with each other via the electronic common area network (ECAN) 122. It is contemplated that any electronic communication between the Motor Control Module (MCM) and the Common Powertrain Controller is acceptable to communicate static faults stored in either, so that each has the most current version of the faults in the other module at any time. The Common Powertrain Controller communicates with the vehicle systems via an SAE data link J1939 and J 1587, (124 and 126, respectively) and it is contemplated that it is equally possible that the Common Powertrain Controller (CPC2) may communicate with the various systems over a UDS link.

Figure 3:
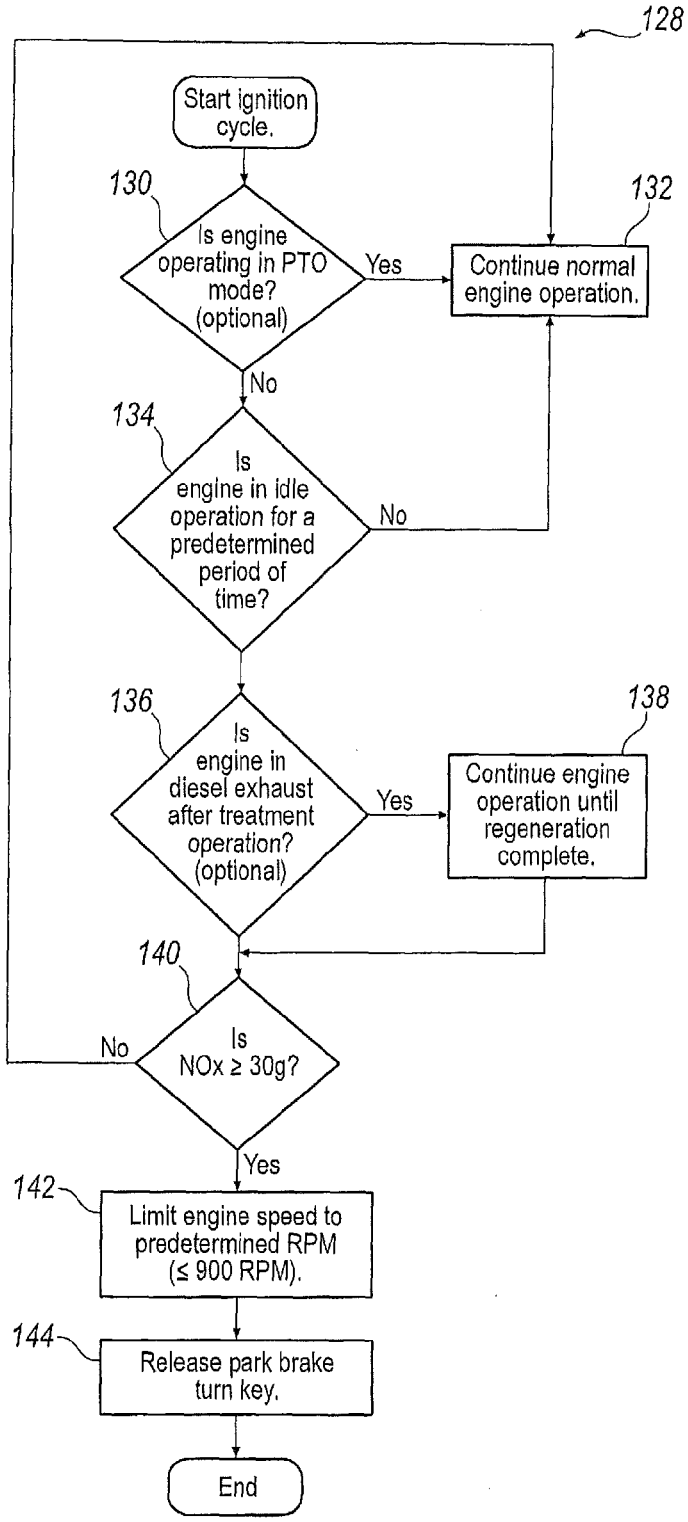
FIG. 3 is a flowchart representation of the method of the present invention.

FIG. 3 is a software flowchart of one method 128 of the present invention. Specifically, step 130 is determining whether the engine is operating in Power Take Off (PTO) mode. As may readily be understood, step 130 is optional, and is included in this description in order for the method to be described within different operation modes of the engine. If it is determined that the engine is operating in PTO mode, step 132 is continue normal engine operation until the PTO mode is completed. After the engine has finished operating in PTO mode, or if it is determined that the engine is not operating in PTO mode, step 134 is determining whether the engine is in idle operation for a predetermined continuous period of time. Generally, the predetermined period of time may be set either by statute, such as, for example by CARB standards, or may be calibratible and predetermined by the operator or fleet owner. The Electronic control Unit MCM has tables or maps in memory that are populated with values or data that indicate the period of time that an engine has operated in continuous idle mode. Whether the engine is operating in idle mode may be determined by reference to engine speed, vehicle speed, road speed, transmission gear, or any other means to determine whether the engine is operating in idle mode. If it determined that the engine is not operating in idle mode, the method loops to step 132 and the engine continues normal operation. If it is determined that the engine is operating in idle mode, the method may proceed to optional step 136, which is determining whether the engine is in diesel exhaust aftertreatment regeneration mode. Some engine ECUs are equipped with a diesel exhaust aftertreatment regeneration mode, that may be whether active or passive, or both. Active regeneration of the diesel exhaust aftertreatment system occurs when the engine is controlled to maximize heat generation so that the diesel particulate filer is freed of particulate material, usual by combusting the hydrocarbon particulates in the Diesel Particulate Filter. In such an example, the engine is operated at a high idle to generate the heat necessary in the exhaust stream to assist in active regeneration. In passive regeneration, idle is controlled at a slightly higher engine speed than a non regenerative state and the heat generated is used to help combust the hydrocarbon particles in the filter. If it is determined that the engine is operating in a diesel exhaust aftertreatment mode, then step 138 is continuing normal engine operation until regeneration is complete. If regeneration is complete, or it is determined that the engine is not operating in regeneration mode, then step 140 is determining whether the NOx in the exhaust gas stream is greater than or equal to a predetermined amount, for example, 30 g, as determined either by sensor data from an exhaust sensor, or as determined by reference to values in a table or data map in ECU memory corresponding to engine idle speed values. readings. If it is determined that the NOx emissions do not exceed a predetermined level, the software loops back to step 132. If yes, then step 142 is limiting engine speed to a predetermined speed (RPM) and in one specific embodiment, to limit the engine speed to less than or equal to 900 rpm. The method will continue this mode of operation until the operator, as at step 144 releases the park brake and turns the key, thereby indicating that the operator wishes to travel, wherein the method loops back to 132 and continues normal engine operation.

While various aspects and embodiments have been detailed, it is apparent that the words used in this application are words of description, and not words of limitation. Many variations and modifications may be made by those skilled in the art without departing from the scope and sprit of the invention as set forth in the appended claims.

We claim:

1. A method to operate a vehicle equipped with an internal combustion engine and a transmission coupled to drive wheels; said vehicle further equipped with a parking brake and having an electronic control unit with memory; said engine in fluid communication with an exhaust aftertreatment system; comprising:

determining whether said engine is operating in idle mode for a predetermined period of time;

determining whether NOx emissions exceed a predetermined level after said predetermined period of time;

limiting said engine speed not to exceed a predetermined engine speed until an operator engages said parking brake and engages an engine ignition switch.

2. The method of claim 1, further including determining whether said engine is operating in Power Take Off Mode (PTO) before determining whether said engine is operating in idle mode for a predetermined period of time.

3. The method of claim 2, wherein when said engine is operating in PTO mode, the engine continues normal engine operation.

4. The method of claim 2, further including determining whether said engine is operating in idle for a predetermined period of time after completing PTO mode of operation.

5. The method of claim 1, further including determining whether said engine is engaged in exhaust aftertreatment regeneration mode before determining whether said NOx emissions exceed a predetermined level.

6. The method of claim 5, wherein said engine continues in normal operation mode if said engine is operating in exhaust aftertreatment regeneration mode.

7. The method of claim 5, further including determining whether the NOx emission exceed a predetermined level after exhaust aftertreatment regeneration is complete.

8. The method of claim 1, wherein said predetermined period of time is calibratable.

9. The method of claim 1, wherein said NOx emission level is greater than or equal to 30 g.

10. The method of claim 1, wherein said engine speed is limited to less than or equal to 900 rpm.

11. The method of claim 1, wherein said engine resumes normal engine operation when said operator engages said parking brake and engages said ignition switch.

* * * * *